US006216304B1

(12) United States Patent
Hotani

(10) Patent No.: US 6,216,304 B1
(45) **Date of Patent: *Apr. 17, 2001**

(54) APPARATUS FOR CLEANING STRIPS

(75) Inventor: Setsuo Hotani, Wakayama-ken (JP)

(73) Assignee: Hotani Co., Ltd., Wakayama-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/055,598

(22) Filed: Apr. 6, 1998

(30) Foreign Application Priority Data

Apr. 10, 1997 (JP) ..... 9-092260

(51) Int. Cl.[7] ..... B08B 1/02

(52) U.S. Cl. ..... 15/77; 15/88.3; 134/64 R; 134/122 R

(58) Field of Search ..... 15/1.51, 77, 88.3, 15/102; 134/64 R, 122 R; 266/113

(56) References Cited

U.S. PATENT DOCUMENTS 2,278,944 * 4/1942 Quigley et al. ..... 15/77
2,321,179 * 6/1943 Boyer ..... 15/77
2,372,599 * 3/1945 Nachtman ..... 15/77 X
5,435,899 7/1995 Gimenez et al. ..... 204/297 R

FOREIGN PATENT DOCUMENTS 086 115 8/1983 (EP) .
235 595 9/1987 (EP) .
520 324 12/1992 (EP) .
58-221300 12/1985 (JP) .
03056699 3/1991 (JP) .
8-258090 10/1996 (JP) .

* cited by examiner

*Primary Examiner*—Mark Spisich
(74) *Attorney, Agent, or Firm*—Knobbe, Martens, Olson & Bear, LLP

(57) ABSTRACT

Disclosed are a method and an apparatus for cleaning a strip, the method comprising electrolytically cleaning a strip by passing the strip between opposed nozzles, one of the nozzles being the anode and the other being the cathode, for ejecting an alkali aqueous solution over the strip, applying a voltage to the nozzles and brushing the strip, in a spray of cleaning water, with a brush roll or brush rolls disposed at a position(s) adjacent to the nozzles downstream thereof in the travelling direction of the strip.

9 Claims, 4 Drawing Sheets

APPARATUS FOR CLEANING STRIPS

BACKGROUND OF THE INVENTION

The present invention relates to a method and an apparatus for cleaning a strip, and more particularly, to a method and an apparatus for cleaning a metal strip by an electrolytically cleaning technique in the steel industry.

DESCRIPTION OF PRIOR ART

Methods for electrolytically cleaning a strip have been conventionally carried out in the iron-manufacturing industry by passing a metal strip between opposed positive and negative plates in an aqueous solution of alkali held in an electrolytic cell. These conventional methods, however, entail the following problems.

Usually a strip passing between the positive and negative plates moves zigzag in the direction of strip thickness. Consequently, the strip may contact or collide with the positive or negative plates due to the zigzag movement. To avoid the contact or collision, the positive and negative plates should be relatively widely spaced away from the strip passing through the alkali solution, or namely the plates should be arranged with a sufficient space. In the arrangement of plates widely spaced away, a large current should be applied to the plates so as to electrolytically clean the strip. Conventionally a current at about 4,000 to about 10,000 amps. has been applied to the plates. If a large current is applied, a serious problem of electric corrosion is raised due to stray current.

If a small current is applied to the plates to overcome the problem of electric corrosion resulting from stray current by application of a large current, a low current density results, leading to a reduced electrolytically cleaning effect.

According to the conventional techniques for electrolytically cleaning a strip, the plates are disposed with a space of about 1.5 m at 10 to 30 locations in the travelling direction of the strip in a strip-cleaning line which is operated at a running speed of about 500 to about 700 m/min.

In this mode of electrolytically cleaning operation, an alkali aqueous solution flows out from an electrolytic cell and can be returned after regeneration or after replenishment with a new alkali aqueous solution outside the electrolytic cell. Even in this case, a large amount of alkali aqueous solution (about 20 to about 30 $m^3$) should be held in the electrolytic cell. This denotes that only a low energy effect is produced in the electrolytically cleaning operation, and that a large-scale electrolytically cleaning equipment is required which incurs a high running cost and a high maintenance cost.

Since the conventional electrolytically cleaning system is of immersion type, the oil deposited on the strip is released into the alkaline bath and unavoidably re-deposits on the strip passing through the alkaline bath, resulting in reduced degreasing or cleaning efficiency in addition to the foregoing deficiency.

SUMMARY OF THE INVENTION

An object of the present invention is to overcome the foregoing prior art problems. Stated more specifically, the object of the invention is to provide a method and an apparatus for cleaning a strip by an electrolytically cleaning technique with the following advantages:

(1) a high electrolytically cleaning efficiency can be achieved by application of a small current;

(2) it is possible to resolve the problem posed by the conventional techniques due to stray current by application of a large current, (3) a high energy effect can be produced by the electrolytically cleaning operation, (4) a significantly small-size electrolytically cleaning equipment compared with conventional one can be provided, (5) the running cost in the electrolytically cleaning operation can be decreased far below the costs heretofore involved, (6) the maintenance cost in the electrolytically cleaning operation can be lowered, and (7) the oil released from the strip by the electrolytically cleaning operation is prevented from redepositing on the strip.

According to the present invention, there is provided a method for cleaning a strip, the method comprising the steps of:

(i) electrolytically cleaning a strip to be cleaned by passing the strip between opposed nozzles for ejecting an alkali aqueous solution over the strip, one of the nozzles being a positive electrode and the other being a negative electrode, and a voltage being applied to the nozzles, and (ii) brushing, in a spray of cleaning water, the strip with a brush roll or brush rolls disposed at a position(s) adjacent to the nozzles of the electrolytically cleaning step (i) downstream of the nozzles in the travelling direction of the strip, the strip being subjected at least once to the procedures in the steps (i) and (ii).

According to the present invention, there is also provided an apparatus for cleaning a strip, the apparatus comprising at least one cleaning unit comprising:

(a) opposed nozzles for ejecting an alkali aqueous solution over the spray between which the strip to be cleaned is passed, one of the nozzles being a positive electrode and the other being a negative electrode, and (b) a brush roll or brush rolls for brushing the strip in a spray of cleaning water, the brush roll or rolls being disposed at a position(s) adjacent to the nozzles downstream thereof in the travelling direction of the strip.

According to the present invention, one of the opposed nozzles for ejecting an alkali aqueous solution over the strip is the anode and the other is the cathode. The strip to be treated is passed between the opposed nozzles, whereby it is electrolytically cleaned.

In this case, when moving zigzag even in a narrow space between the nozzles, the strip neither contacts nor collides with the nozzles for the following reasons.

The solution is forced out from the nozzles at a pressure which is inversely proportional to the distance between the nozzle and the strip. Consequently, the strip coming closer to the nozzles is exposed to a higher pressure according to the distance between the nozzle and the strip. The nearer the strip moves, the more strongly it is prevented from moving closer by a higher pressure.

According to the invention, when the alkali aqueous solution is supplied, at a pressure of 1 $kg/cm^2$, to the nozzles spaced by 10 mm from the strip, the strip can pass between the nozzles without contact nor collision with the nozzles serving as the electrodes.

In accordance with the present invention, the opposed electrodes can be arranged with such a short space that a high electrolytically cleaning efficiency can be achieved by application of a small current which overcomes the prior art problem of electric corrosion owing to stray current by application of a large current.

According to the present invention, the current density per input unit of power can be much more increased than in the prior art, whereby a strip can be electrolytically cleaned with a noticeably high efficiency.

For example, the desired electrolytically cleaning effect can be produced using nozzles, 7 to 8 mm in size in the strip-travelling direction, in the strip-cleaning line which is operated at the above-mentioned running speed. In this embodiment, a large amount of electrolyte need not be held in the electrolytic cell so that a high energy effect can be achieved by the electrolytically cleaning operation.

Stated more specifically, the electrolytically cleaning effect can be achieved as contemplated by application of power of 10 amps. at 7–8 volts using a single cleaning unit with nozzles of the above-mentioned size arranged at a distance of 10 mm between the nozzle and the strip in a strip-cleaning line which is operated at the above running speed. In contrast, the conventional techniques require power of 4,000 to 10,000 amps. at 20 volts in a strip-cleaning line which is operated at the same running speed.

According to the invention, a significantly smaller size electrolytically cleaning equipment can be provided, and the electrolytically cleaning equipment can be operated at a far lower running cost and can be maintained at a lower cost, than in the prior art.

The oil deposited on the strip can be removed from the strip in a short time by the above-mentioned electrolytically cleaning operation. The oil loosely existing to the strip surface can be easily washed away by the alkali aqueous solution ejected from the nozzles.

In the brush cleaning step, the strip is exposed to a spray of cleaning water and simultaneously brushed with a brush roll or brush rolls arranged next to the electrolytically cleaning means downstream thereof in the travelling direction of the strip. As a result, the oil remaining on the strip can be effectively removed by the brush roll or brush rolls in the brush cleaning step.

Therefore, the oil particles existing in the electrolyte can not be re-deposited on the strip in the invention unlike the conventional immersion-type electrolytically cleaning system, so that a high electrolytically cleaning efficiency can be achieved in the invention in this respect, and the energy effect can be enhanced by the electrolytically cleaning operation. Iron particles can also be eliminated from the strip in the brush cleaning step.

In the practice of the invention, when the strip is subjected a plurality of times to the electrolytically cleaning step and the brushing cleaning step to be executed in the strip-travelling direction, the strip cleaned by the preceding cleaning operation is further cleaned by the subsequent cleaning operation, whereby a better cleaning result is given.

DETAILED DESCRIPTION OF PREFERRED EMBODIMENTS

Figure 1:
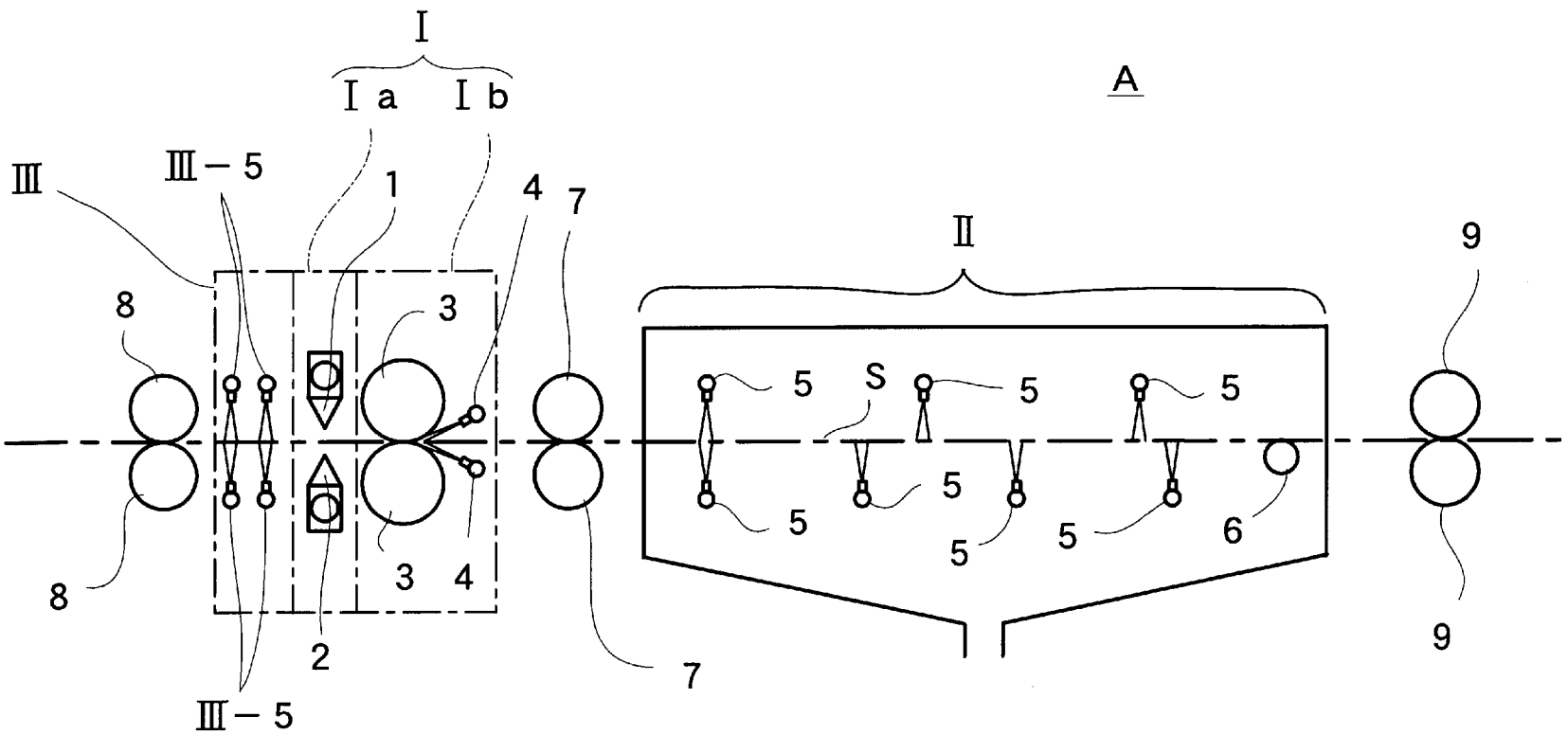
FIG. 1 is a front view schematically showing an embodiment of the system for cleaning a strip according to the present invention.

Preferred embodiments of the invention are described below with reference to the accompanying drawings.

Indicated at a reference character A is an apparatus for cleaning a strip as a whole. The apparatus A comprises a cleaning unit I. The cleaning unit I includes a first section Ia and a second section Ib.

The first section Ia includes nozzles 1, 2 arranged as vertically opposed. One of the nozzles 1, 2 is a positive electrode and the other is a negative electrode from each of which an alkali aqueous solution is ejected. The first section Ia is one wherein the electrolytically cleaning step for a strip S to be cleaned is carried out.

The second section Ib includes a brushing roll(s) 3 for brushing the strip S in a spray of cleaning water. The second section Ib is one wherein the brush cleaning step for the strip S is carried out. The brushing roll(s) 3 in the second section Ib is disposed next to the nozzles 1, 2 in the first section Ia downstream thereof in the travelling direction of the strip S.

The nozzles 1, 2 are connected to lines 1*a*, 2*a* for supply of alkali aqueous solution. The alkali aqueous solution ejected from the nozzles 1, 2 is passed through a circulating line (not shown) and is returned to the lines 1*a*, 2*a* for reuse.

Figure 2:
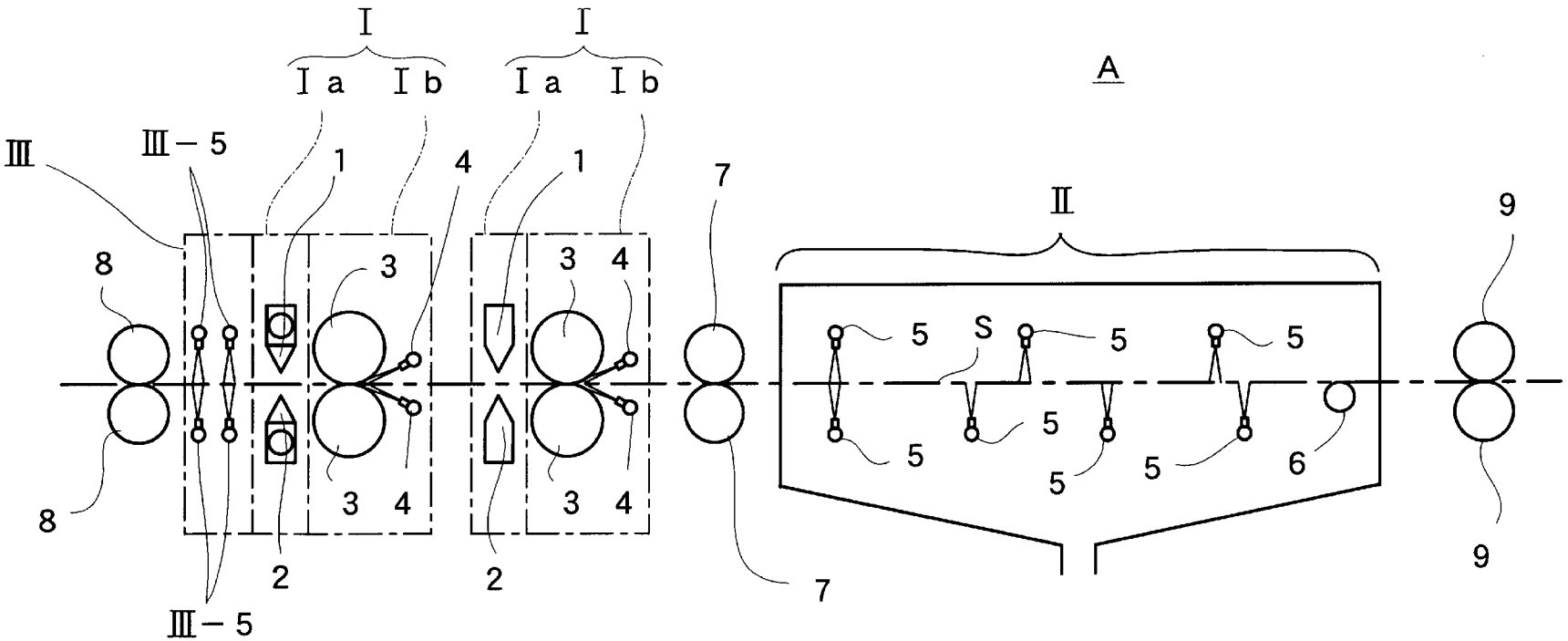
FIG. 2 is a front view schematically showing another embodiment of the system for cleaning a strip according to the present invention.
Figure 3:
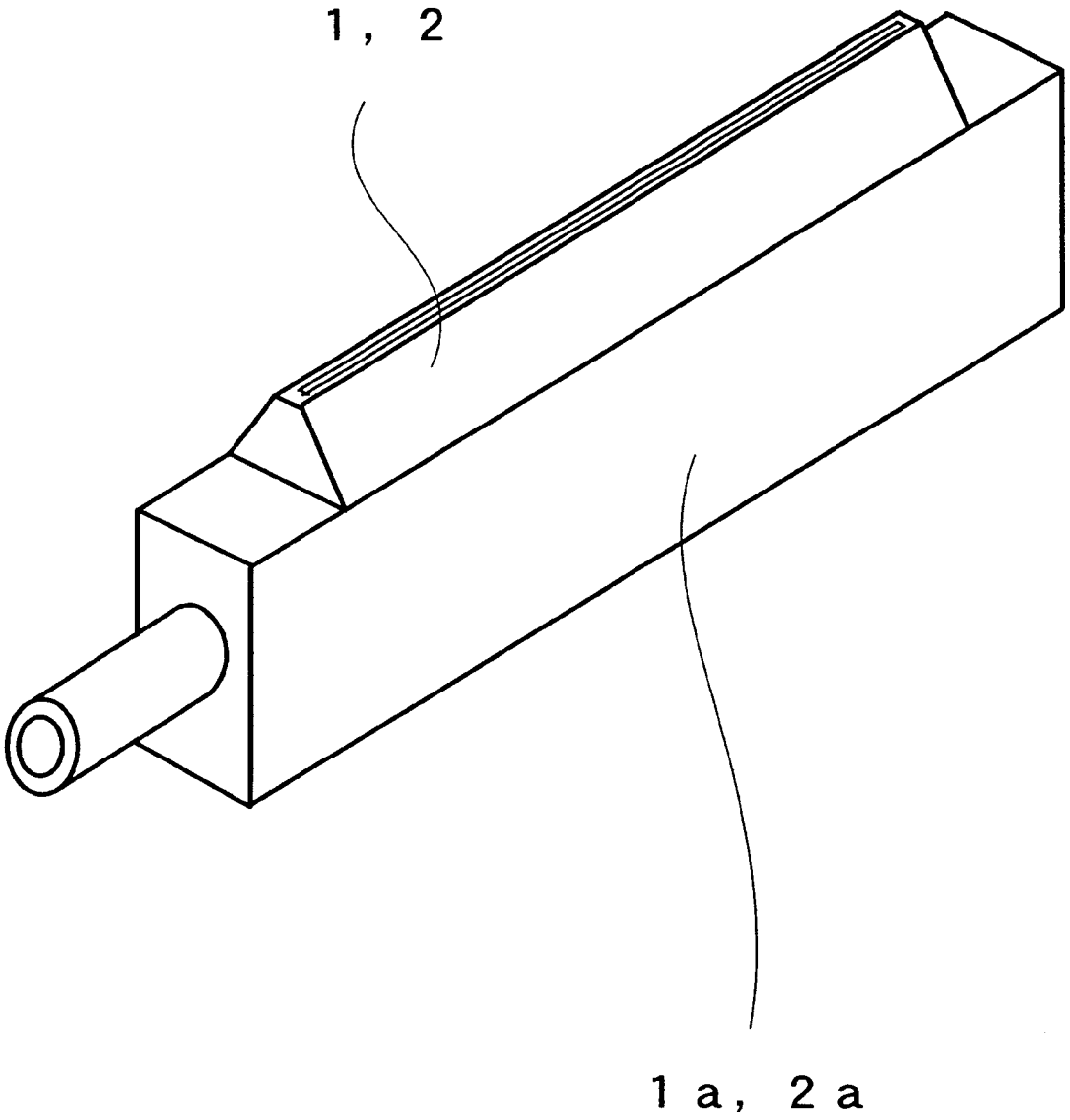
FIG. 3 is a perspective view of the nozzles in the systems for cleaning a strip as shown in FIGS. 1 and 2.
Figure 4:
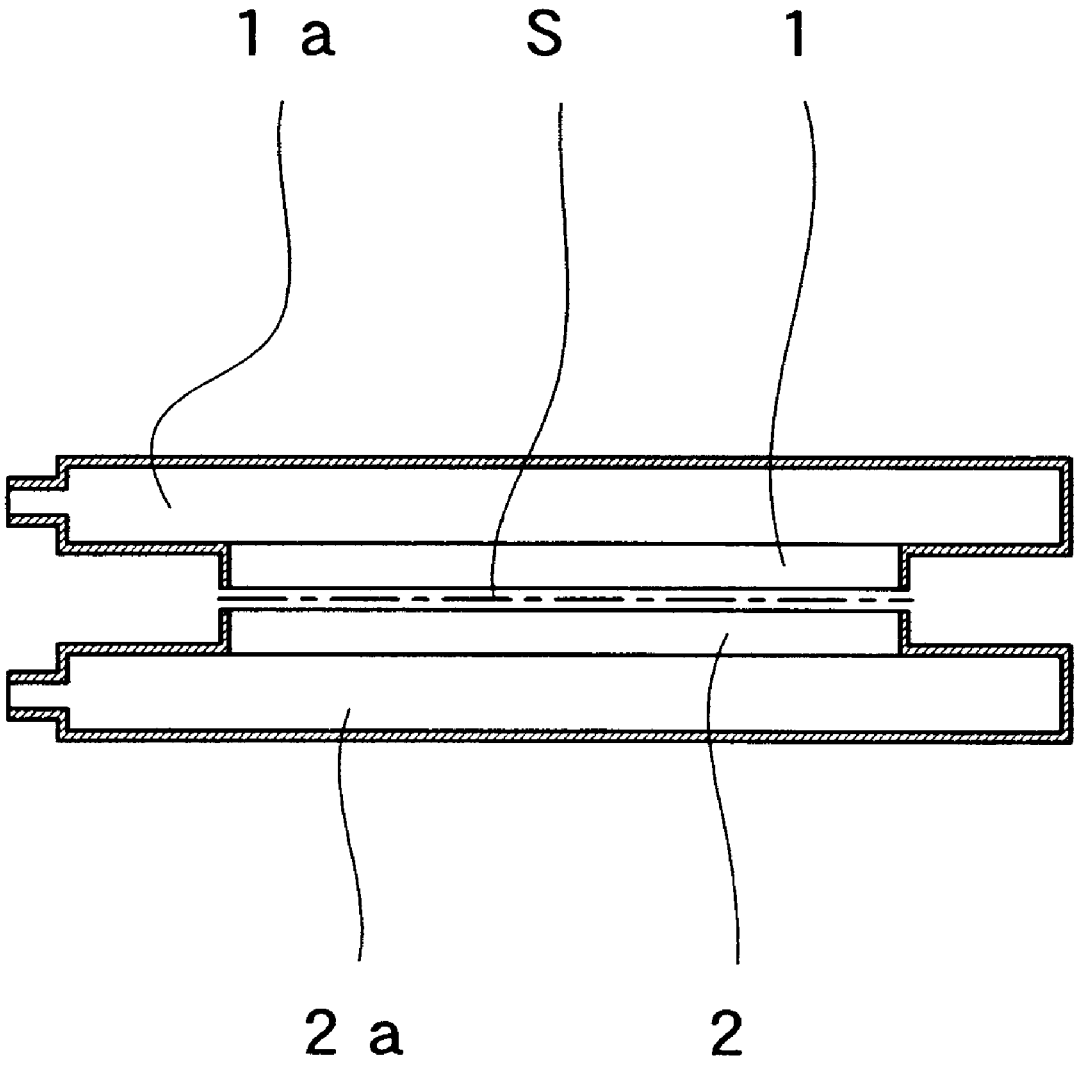
FIG. 4 is a section view schematically showing an nozzle to be arranged in the systems for cleaning a strip as shown in FIGS. 1 and 2.

The cleaning unit I including the first and second sections Ia, Ib may be disposed singly as shown in FIG. 1 or may be arranged in a plurality in the travelling direction of the strip S as shown in FIG. 2.

The brush roll(s) 3 in the second section Ib can be any of conventional brush rolls. The cleaning water is sprayed by the per se known method concurrently with brushing with a brush roll(s) 3. Accordingly the mode of spraying the cleaning water and the mode of bushing with a brush roll or brush rolls are only diagrammatically represented in the drawings. Designated 4 is a nozzle for spraying the cleaning water as an example of means for spraying the cleaning water.

In the illustrated embodiments, the apparatus A has a rinsing-type cleaning unit II disposed next to the cleaning unit I downstream thereof in the travelling direction of the strip S. The cleaning unit II may be conventional. A spray header for the cleaning water is designated 5 and a back-up roller for the strip S is designated 6.

A wringer roller 7 is disposed between the cleaning unit I and the cleaning unit II set next thereto, a wringer roller 8 is disposed on the side of entry into the first section Ia and a wringer roller 9 is disposed on the side of exit from the cleaning unit II.

A voltage is applied to the nozzles 1, 2 one of which is the anode and the other of which is the cathode. An alkali aqueous solution is forced out from the nozzles 1, 2.

The strip S to be cleaned is passed between the opposed nozzles 1, 2 while being exposed to a jet of the alkali aqueous solution forced out from the nozzles 1, 2, whereby the strip S is electrolytically cleaned.

In the electrolytically cleaning operation, it is preferred to apply a voltage to the nozzles 1, 2 when the running speed of the strip S travelling in the strip-cleaning line has reached 10 m/min or more instead of applying a voltage immediately after the beginning of travelling. If a voltage is applied immediately after the beginning of running, damage such as change of property may be inflicted on the strip. The damage is caused presumably because a current applied to the nozzles 1, 2 flows into the strip and heats the strip. The problem of causing such damage is obviated if a voltage is applied to the nozzles 1, 2 when the running speed of the strip S travelling in the strip-cleaning line has reached 10 m/min or more.

Of the nozzles 1, 2, preferably the nozzle positioned above is the cathode and the one positioned below is the anode. If the arrangement of nozzles 1, 2 is reverse to the foregoing exemplar, the strip to be cleaned may be insufficiently cleaned on side portions. This problem would be overcome if the upper nozzle is the cathode and the lower nozzle is the anode.

The nozzles 1, 2 are vertically opposed, and preferably diametrically opposed. If the nozzles 1, 2 are provided in diametrically opposite arrangement, the strip can be cleaned at the best electrolysis intensity.

The strip S to be cleaned is wetted with cleaning water at a location adjacent to the side of entry into the cleaning unit I and is passed through the first section Ia. In this case, the strip S is electrolytically cleaned with an enhanced effect.

In FIGS. 1 and 2, a zone III is one wherein the strip S is wetted with cleaning water at a location adjacent to the side of entry into the cleaning unit I, and a spray III-5 is disposed in the zone III.

The strip S which has passed through the first section Ia is cleaned by being brushed, in a spray of cleaning water, with a brush roll or brush rolls 3 at a position(s) adjacent to the nozzles 1, 2 downstream thereof in the travelling direction of the strip S.

In the illustrated embodiments, the strip S treated at the second section Ib in the terminal end of the cleaning unit I is rinsed with water in the cleaning unit II.

The oil remaining on the strip S cleaned in the cleaning unit I is removed by cleaning in the cleaning unit II. In this case, the remaining oil so loosely exist to the strip that the oil can be efficiently washed away in the cleaning unit II.

What is claimed is:

1. An apparatus for cleaning a strip, the apparatus comprising at least one cleaning unit comprising:

(a) a pair of opposed nozzles for ejecting an alkali aqueous solution over the strip between which the strip to be cleaned is passed, one of the nozzles being a positive electrode and the other being a negative electrode, each nozzle (i) being arranged to eject an alkali aqueous solution in a direction perpendicular to and toward the strip, (ii) projecting toward the strip, and (iii) having an ejection slit extending the width of the strip;

(b) at least one brush roll for brushing the strip, the brush roll being disposed at a position adjacent to one of the nozzles downstream in the travelling direction of the strip; and (c) at least one nozzle for spraying cleaning water located adjacent to the brush roll, said at least one cleaning water nozzle being arranged to direct a stream of cleaning water toward the brush roll wherein the strip is brushed in a spray of the cleaning water.

2. The apparatus according to claim 1, further comprising a plurality of cleaning units for spraying the strip with cleaning water provided downstream of the nozzles for ejecting an alkali solution in the travelling direction of the strip.

3. The apparatus according to claim 1, further comprising at least one spray for spraying the strip with cleaning water at a location adjacent to the aqueous alkali nozzles upstream thereof in the travelling direction of the strip.

4. The apparatus according to claim 1, wherein the opposed nozzles are arranged in upper and lower positions and wherein the nozzle positioned above is the cathode and the one positioned below is the anode.

5. The apparatus according to claim 1, wherein said at least one brush roll is a pair of brush rolls, each aligned on an opposite side of the strip, downstream of a pair of the opposing nozzles.

6. The apparatus according to claim 1, wherein the opposing nozzles are spaced by approximately 10 mm from the strip.

7. An apparatus for cleaning a strip, the apparatus comprising at least one cleaning unit comprising:

(a) a pair of opposed nozzles for ejecting an alkali aqueous solution over the strip between which the strip to be cleaned is passed, one of the nozzles being a positive electrode and the other being a negative electrode, each nozzle (i) being arranged to eject an alkali aqueous solution in a direction perpendicular to and toward the strip, (ii) projecting toward the strip, and (iii) having an ejection slit extending the width of the strip;

(b) a pair of opposed brush rolls for brushing the strip, the brush rolls each aligned on an opposite side of the strip and disposed at a position adjacent to the pair of opposed nozzles downstream in the travelling direction of the strip; and (c) at least one nozzle for spraying cleaning water located downstream of the brush roll, said at least one cleaning water nozzle being arranged to direct a stream of cleaning upstream relative to the travelling direction of the strip and toward the space between the opposed brush rolls.

8. The apparatus according to claim 7, further comprising a plurality of cleaning units for spraying the strip with cleaning water provided downstream of the nozzles for ejecting an alkali aqueous solution in the travelling direction of the strip.

9. The apparatus according to claim 7, wherein the opposed nozzles are arranged in upper and lower positions and wherein the nozzle positioned above is the cathode and the one positioned below is the anode.

* * * * *

UNITED STATES PATENT AND TRADEMARK OFFICE

CERTIFICATE OF CORRECTION

PATENT NO. : 6,216,304 B1
DATED : April 17, 2001
INVENTOR(S) : Setsuo Hotani

It is certified that error appears in the above-identified patent and that said Letters Patent is hereby corrected as shown below:

Column 6,
Line 2, "alkali solution" should be -- alkali aqueous solution --

Signed and Sealed this

Twenty-sixth Day of March, 2002

*Attest:*

*Attesting Officer*

JAMES E. ROGAN
*Director of the United States Patent and Trademark Office*